US005109681A

United States Patent [19]

Schmid et al.

[11] Patent Number: 5,109,681

[45] Date of Patent: May 5, 1992

[54] DEVICE FOR THE SELECTIVELY CONTROLLED MUTUAL DISPLACEMENT OF YARN GUIDES OF FLAT-BED KNITTING MACHINES

[75] Inventors: Franz Schmid, Bodelshausen; Jurgen Ploppa, Pfullingen, both of Fed. Rep. of Germany

[73] Assignee: H. Stoll GmbH & Co., Reutlingen, Fed. Rep. of Germany

[21] Appl. No.: 548,822

[22] Filed: Jul. 6, 1990

[30] Foreign Application Priority Data

Jul. 8, 1989 [DE] Fed. Rep. of Germany ..... 3922513

[51] Int. Cl.[5] ..... D04B 15/38; D04B 15/56

[52] U.S. Cl. ..... 66/126 R

[58] Field of Search ..... 66/126 R, 127, 128, 66/129

[56] References Cited

U.S. PATENT DOCUMENTS 4,354,363 10/1982 Inoue ..... 66/128
4,658,603 4/1987 Stoll et al. ..... 66/126 R
4,738,124 4/1988 Stoll et al. ..... 66/127
4,881,382 11/1989 Stoppazzini ..... 66/126 R

FOREIGN PATENT DOCUMENTS 3606821 2/1987 Fed. Rep. of Germany .
227465 9/1985 German Democratic Rep. ... 66/126 R
655145 3/1986 Switzerland .
1269109 4/1972 United Kingdom ..... 66/127

*Primary Examiner*—Werner H. Schroeder
*Assistant Examiner*—John J. Calvert
*Attorney, Agent, or Firm*—Jones, Tullar & Cooper

[57] ABSTRACT

A device for the selectively controllable mutual displacement of yarn guides of flat-bed knitting machines has a plurality of electromagnets fixed against motion on a carriage unit, to each one of which a mutual displacement device is controllably assigned, the mutual displacement finger of which can be brought into and out of contact with at least one associated yarn guide box of a yarn guide, movable parallel to a needle bed unit along yarn guide rails. In order to make the transfer of motion from the electromagnet to the mutual displacement finger more rapid and independent of the direction of motion of the carriage unit in such a device for the selectively controllable mutual displacement of yarn guides of flat-bed knitting machines, it has been provided that the electromagnet be surrounded by a frame element, from the center of one end of which the mutual displacement finger protrudes in the direction of movement and the other end of which can be acted upon by an armature rod of the associated electromagnet, and that the frame element is supported in a longitudinally movable manner on its two side legs.

12 Claims, 2 Drawing Sheets

DEVICE FOR THE SELECTIVELY CONTROLLED MUTUAL DISPLACEMENT OF YARN GUIDES OF FLAT-BED KNITTING MACHINES

FIELD OF THE INVENTION

The present invention relates to a device for the selectively controlled mutual displacement, or taking along, of yarn guides of flat-bed knitting machines, with preferably a plurality of electromagnets fixed against motion on a carriage unit, to each one of which a mutual displacement device is controllably assigned, the mutual displacement finger of which can be brought into and out of contact with at least one associated yarn guide box of a yarn guide, movable parallel to a needle bed unit along yarn guide rails.

BACKGROUND OF THE INVENTION

In such a device for the selectively controlled mutual displacement of yarn guides of flat-bed knitting machines of this type, known from German DE 36 06 821 A1 or Swiss CH 655 145 A5, the electromagnet is connected to the mutual displacement or take-along finger by means of a lever mechanism. In the first case the mutual displacement finger is activated by a parallel tension spring and provided with a bolt extending away from it. The mutual displacement finger is seated in a one-armed lever, which is pre-stressed by a further tension spring and can be activated by the electromagnet for unlocking the mutual displacement finger. In the second case a two-armed lever is provided, one end of which is activated by a spring-loaded armature rod of the electromagnet and the other end of which is connected with the mutual displacement finger for moving the latter up and down.

A disadvantage of both known devices is that the transfer of the motion from the electromagnet to the mutual displacement finger is relatively sluggish because of the lever-like transfer elements. This is inherent because of the masses to be moved, on the one hand, and because of the plurality of the elements transferring the motion, on the other. A further disadvantage is the asymmetrical location of the electromagnets in relation to the mutual displacement finger, which results in an uneven distribution of forces at the mutual displacement finger, which depends on the direction of motion at the mutual displacement finger and the maximally appearing force of which must be provided by the electromagnet. This results in a control- or operating time of the mutual displacement finger, which is dependent on the operational state at the time in, which is unsatisfactory.

Although in a device for the selectively controlled mutual displacement of yarn guides of flat-bed knitting machines, known from East German DD-227 465 A, the mutual displacement finger arrangement consisting of two parallel mutual displacement fingers is fastened on one end of an armature rod of the electromagnet, because of the axial arrangement of the armature rod and the mutual displacement finger arrangement a guide section located between them is required for the axial movement of the mutual displacement finger arrangement. This increases the structural height of this device. Therefore the device in accordance with the above mentioned German DE 36 02 821 A1 was used again, where the electromagnet and the mutual displacement finger are disposed parallel to each other, which has the disadvantages mentioned above.

SUMMARY OF THE INVENTION

It is the object of the present invention to provide a device for the selectively controlled mutual displacement of yarn guides of flat-bed knitting machines of the previously mentioned type, where the transfer of motion from the electromagnet to the mutual displacement finger is faster and independent of the direction of motion of the carriage unit, while the structural height remains virtually unchanged.

This object is attained in a device for the selectively controlled mutual displacement of yarn guides of flat-bed knitting machines of the previously mentioned type in that the electromagnet is surrounded by a frame element, from the center of one end of which the mutual displacement finger protrudes in the direction of movement and the other end of which can be acted upon by an armature rod of the electromagnet, and in that the frame element is supported in a longitudinally movable manner on two side legs.

Because of the symmetrical arrangement of the frame element on the electromagnet and the central arrangement of the mutual displacement finger resulting from this, it has been attained that the forces acting on the mutual displacement finger are always evenly distributed on the guides of the frame element, so that the frame element and with it the mutual displacement finger can be moved in every direction of motion of the carriage unit in the same way or with the same amount of force. Because there are no transfer elements, such as levers or the like, the transfer of motion from the electromagnet to the frame element and thus to the mutual displacement finger can take place more rapidly, in particular because the frame element can be manufactured of materials which are lighter than metal, i.e. for example essentially in its entirety of plastic. Because of this, the magnetic forces to be generated can be reduced.

In the device known from German DE 36 06 821 A1, the plurality of the electromagnets with the lever mechanisms and the mutual displacement fingers has been inserted in several rows of recesses in a block-like holder. This is a disadvantage from the viewpoint of adjustment as well as of maintenance. In a preferred exemplary embodiment of the present invention, according to which the electromagnet is encapsulated in a rectangular-shaped housing, guide plates are fixed on two opposite long sides of the housing, and the frame element is guided between the guide plates and the housing; and according to which the electromagnet with the housing, guide plates and the frame element as a complete component, together with further like components, is fixed in a row on a cross piece which is fixedly connected with the carriage unit are provided to remedy this situation. Thus, in accordance with this preferred embodiment, every yarn guide or a plurality of yarn guides disposed on a yarn guide rail is controlled by a structurally homogenous, complete component consisting of the electromagnet with the housing, guide plates and frame element which includes the mutual displacement finger.

The guidance of the frame element is realized in a structurally simple manner in that the guide plate is provided with an axial guide groove open towards the housing.

The mutual displacement finger may be fastened, for example as a metallic component, on a frame element. However, provision is made for forming the mutual displacement finger and the frame element of one piece with the frame element made of plastic for simplifying the manufacture.

In accordance with a further exemplary embodiment, the provision is made for the lower and/or the upper crossleg of the frame element to have on its interior two axial run-off pieces placed at a distance from each other which come into contact with the magnet housing for a simple and cost-efficient realization of the limitation of the lift of the frame element in one and/or both directions.

The movement of the frame element into an interacting position with the mutual displacement finger is aided by a central axial pressure spring provided between the electromagnet housing and the lower crossleg.

With the upper crossleg provided with an axial adjustment screw, which is located opposite the armature rod of the electromagnet, it is possible to adjust the forward lift of the armature rod before it reaches the frame element in order to sever the connection it or the mutual displacement finger has with the respective yarn guide box.

The disconnection of the mutual displacement finger of the frame element from a yarn guide box takes place in the course of a carriage lift, so that the frictional force between the mutual displacement finger and the corresponding abutting surface area of the yarn guide box must be overcome by the armature rod of the electromagnet when pushing the frame leg upwards. This increased initial force is transferred to the upper crossleg of the frame element. This crossleg can bend slightly and transfer this to the longitudinal legs, so that the frame element nevertheless remains easily movable in the guide plate without tilting or friction. Preferably, the upper crossleg is provided with an axial adjustment screw located opposite the armature rod of the associated electromagnet, and the side legs of each frame element are each provided with at least one groove-like recess extending along their length. This embodiment (s) also prevents impact oscillations from occuring at the end of the disconnecting movement of the frame element at the time when its lower striking faces impact on the electromagnet. These oscillations can be essentially absorbed.

Further details of the invention can be seen in the following description, in which the invention will be described and explained in detail by means of the exemplary embodiment shown in the drawings.

DETAILED DESCRIPTION OF THE PREFERRED EMBODIMENT

Figure 1:
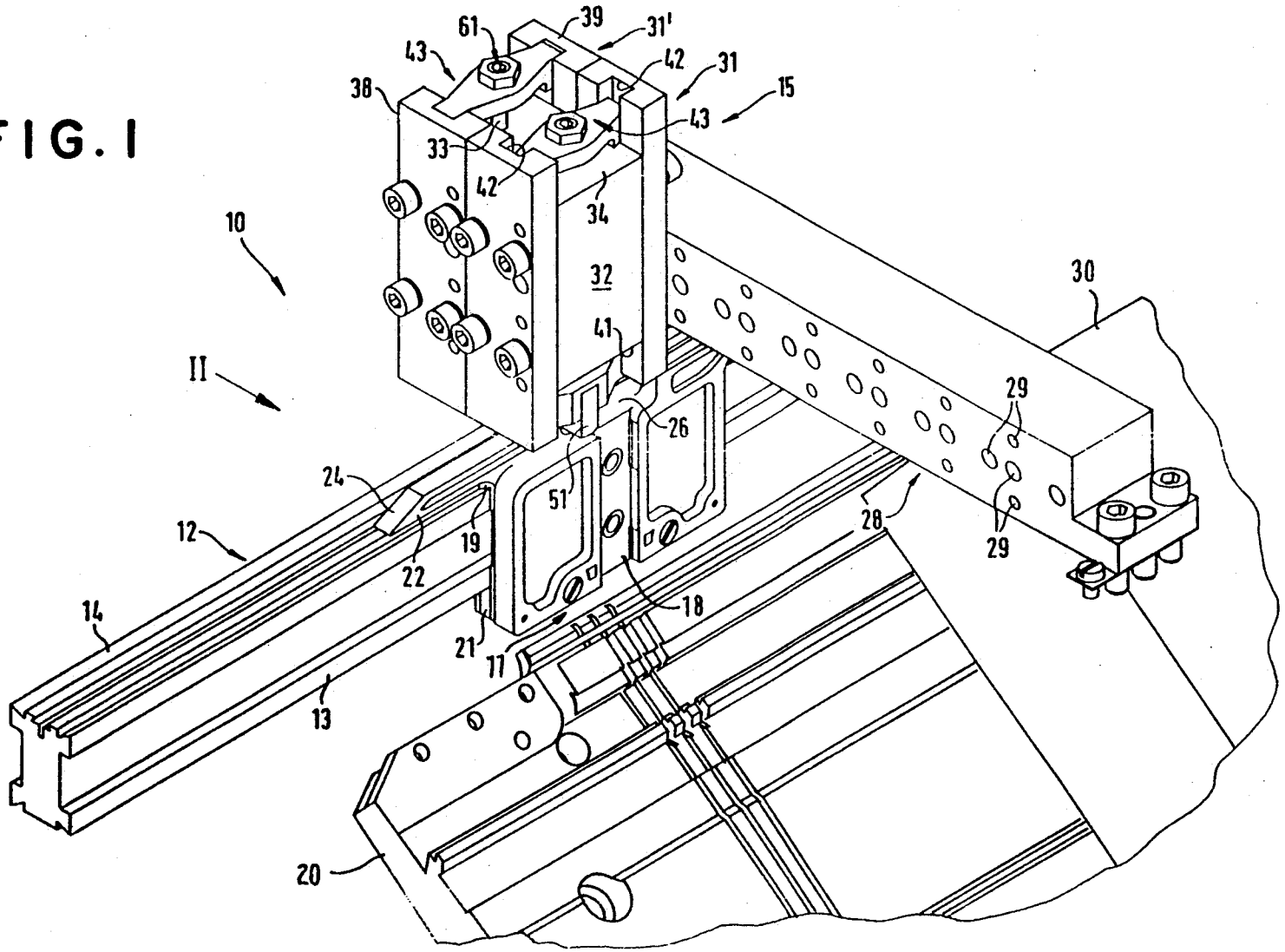
FIG. 1 is a perspective view of a device, as a part of a flat-bed knitting machine, for the selectively controllable mutual displacement of yarn guides.

The device 10 illustrated in the drawings is used for the selectively controllable mutual displacement of yarn guides, each one of which is fixed on a yarn guide box 11 in a manner not further shown. One or several of the yarn guide boxes 11, here only shown schematically, can be moved back and forth along the lateral guide path 13 or 14 of a guide rail 12. Usually a flat-bed knitting machine is provided with a plurality of guide rails 12, which are disposed parallel to each other along the needle bed arrangement 20. The yarn guide boxes 11 are mutually displaced or retained in a selectively controlled manner by a selecting device 15 which, in a manner not shown, is connected to be fixed against movement on a carriage unit 30 of a flat-bed knitting machine.

The yarn guide box 11 has a vertical slot 18 on its exterior for the insertion and fastening of an arm of a yarn guide, not shown. The yarn guide box 11 is provided on the top and bottom with guide bars 19, 21, which extend over the guide path 13 in a form-fitting manner. In the direction of the longitudinal extension of the guide rail 12, run-off pieces 22 and 23 are formed on the upper guide strip, each of which is provided with an oblique run-off surface 24. A slot 26 is provided between the two run-off pieces 22 and 23, by means of which the respective yarn guide box 11 can be mutually displaced by the selecting device 15 in one or the other direction.

The selecting device 15 has an arm or crosspiece 28 which is connected to be held stationary in a manner not shown, with one of its ends on the carriage unit from which, it extends in a cantilevered or bridge-like manner above and crosswise over the plurality of guide rails 12. The arm is provided with fastening bores 29 at regular intervals, on which components 31 for the selectively controlled mutual displacement of the yarn guide boxes 11 or their yarn guides, not shown, are fixed. Such a control component 31 is disposed over every guide path 13, 14 of the guide rails 12.

Figures 2, 3:
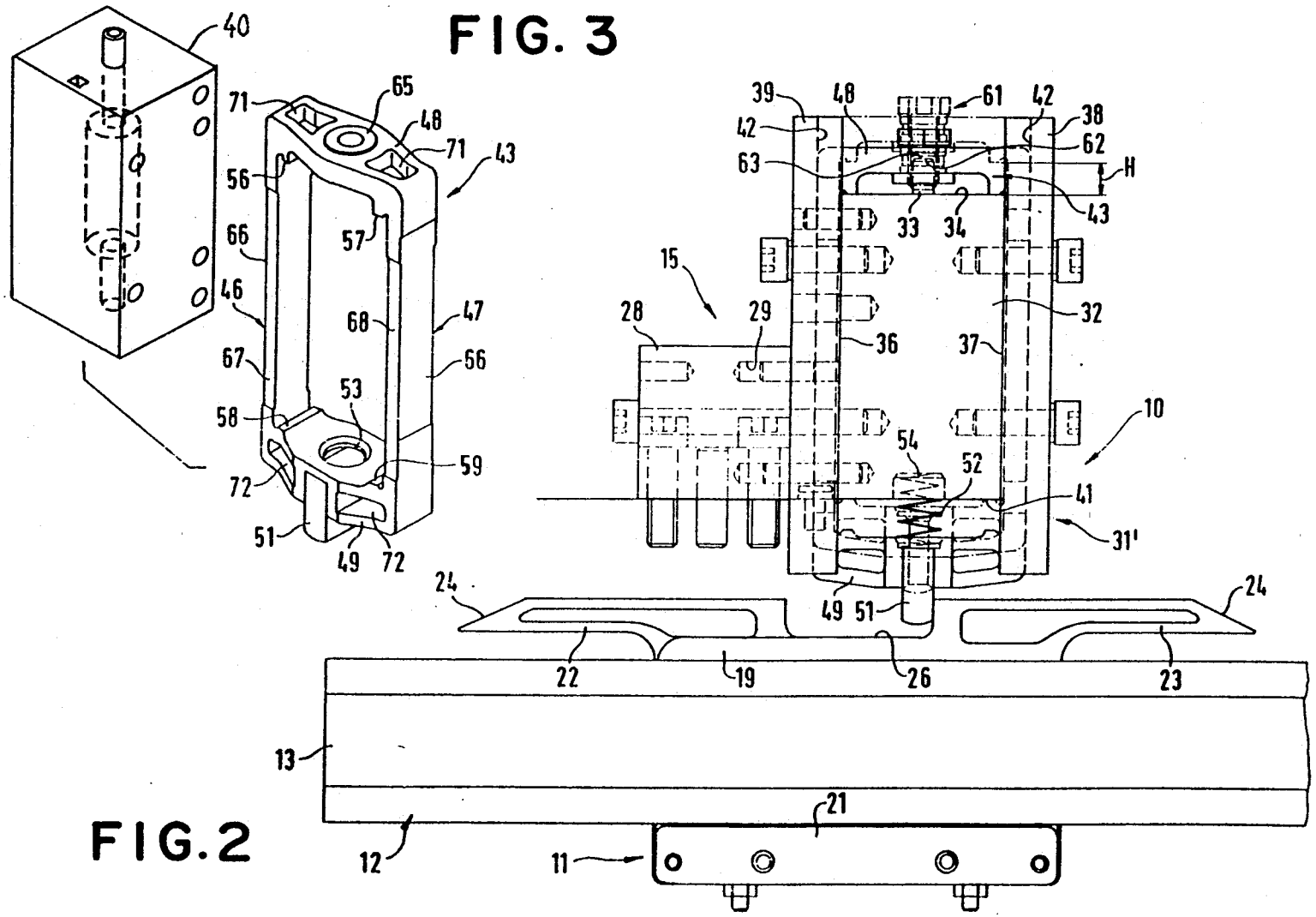
FIG. 2 is a view taken in the direction of the arrow II of FIG. 1.
FIG. 3 is a detail perspective view of a frame element of the device in accordance with FIG. 1.

The component 31 has an electromagnet 40, not shown in detail, which is surrounded by a rectangularly shaped housing 32. Only the armature rod 33 of this electromagnet is visible in the drawings, which may extend through the top 34 of the magnet housing 32. The electromagnet is of the bipolar type, for example, where the armature rod 33 is maintained in its upwardly extended position by a permanent magnet. Guide plates 38 and 39 are fixed on the two narrow sides 36, 37 of the magnet housing 32. The two guide plates extend beyond the top 34 as well as the bottom 41 of the magnet housing and are provided across their center with a longitudinally extending guide groove 42. A yoke in the form of a frame element 43 is maintained in an upwardly and downwardly movable manner in these guide grooves 42 of the two guide plates 38, 39, which may be of metal or plastic. In this case the respective long sides 36, 37 of the magnet housing 32 also serve as guide surfaces. The frame element 43 which, for example, may be of plastic, surrounds the magnet housing 32. Thus it is made of one piece, two parallel longitudinal legs 46, 47 and two crosslegs 48 and 49 extending parallel to each other and crosswise over the top 34 and the bottom 41 of the magnet housing 32. The frame element 43 is shown in detail in FIG. 3. A mutual displacement finger 51 is disposed in the center of the lower crossleg 49, which may either be of one piece with the frame element 43 or, as shown in the drawings, as an individual element of, for example metal, and held and fastened in a suitable groove of the lower crossleg 49.

In its crosswise extent the frame element 43 has an interior width which is approximately the same as the width of the magnet housing 32, however, in its longitudinal extent it has an interior width which is greater than the long extension of the magnet housing 32. A compression spring 52 is disposed between the inside of the lower crossleg 49 and the bottom 41 of the magnet housing 32. one end of which is seated in a blind bore receptacle 53 in the lower crossleg 49 and the other end in a blind bore receptacle 54 of the bottom 41 of the magnet housing or of the electromagnet itself. In this way and as shown on the component 31 of FIG. 1, the frame element 43 is maintained downwardly displaced in its one end position in such a way, that the mutual displacement finger 51 extends into the slot 26 of the yarn guide box 11. Thus this position of the frame element 43 is the mutual displacement position. Limitation of this movement into the mutual displacement position is accomplished by ledges 56, 57, which are provided laterally on the inside of the upper crossleg 48 of the frame element 42 and protrude from it and which come into contact with the top 34 of the magnet housing 32. As illustrated, on the component 31' in FIG. 1, the frame element 43 can be held in its upper, unlocked position against the force of the compression spring 52 by the armature rod 33 of the magnet. This position, attained by a lifting move H from the bottom to the top, is defined by the ledges 58 and 59 which are provided laterally on the inside of the lower crossleg 49 and protrude from it, and which come into contact with the bottom 41 of the magnet housing 32.

Furthermore, an adjustment screw unit 61 is provided in the upper leg 48, which is provided with a threaded bushing 65 fixedly inserted into the upper crossleg 48 and by which it is possible to set the clear distance of its inner actuation end 62 to the actuation end 63 of the armature rod 33 in the mutual displacement position of the frame element 43. In this way it is accomplished that the armature rod 33, when it is disengaged by the magnetic action, first performs a free lift before it pushes the frame element 43 upwards into its disengagement position. When the magnetic field is cancelled, the armature rod 33 falls downward because of its weight and is followed by the frame element 43, this effect being assisted by the compression spring 52. In a known manner the movement of the frame element 43 out of its mutual displacement position into its disengagement position can also take place in that the mutual displacement finger 51 is moved into the disengagement position when riding over one of the run-off pieces 22, 23 and then can no longer fall back after reaching the slot 26, because in the meantime the armature rod 33 has been magnetically moved into its disengagement position.

The frame element 43 is designed in such a way that its longitudinal and crosslegs 46 to 49 are flexible in the area of the U and in that the frame element as a whole can be moved up and down in the guide plates 38, 39 freely and while absorbing shock, even under load. For this purpose the longitudinal legs 46, 47 have recesses 66 or 67, 68 of small depth on their outside as well as the two narrow front sides over a considerable portion of their length, where the one recess 66 is disposed offset in height in respect to the two recesses 67 and 68. The exterior width of the frame element and the dimensions of the upper and lower area of the longitudinal legs 46, 47 are such that the frame body 43 is guided with play in the grooves 42 of the guide plates 38, 39. The upper and the lower crossleg 48, 49 have reductions in their cross section in the form of lateral grooves 71 or lateral openings 72 passing through them. In this way an easy guidance of the frame element 43 is assured during operation when, while overcoming a frictional force, it is pushed upward by the armature rod 33 between the mutual displacement finger 51 and the wall area of the slot 26 of the yarn guide box 11. Furthermore, impact oscillations which would occur because of the upward movement limitation would be essentially damped or absorbed.

In accordance with the invention, the components 31 or 31' are made compactly, so that they can be placed in a space-saving manner on the arm 28. Furthermore, they also contain in a compact manner the electromagnet as well as the frame element 43, including the guidance of the latter, and the mutual displacement finger 51 for taking along a yarn guide box 11.

What is claimed is:

1. A device for the selectively controllable mutual displacement of yarn guides of flat-bed knitting machines, comprising:

a plurality of electromagnets fixed on a carriage unit against motion relative thereto, each electromagnet including an armature rod;

a plurality of yarn guide rails;

a yarn guide box mounted to and displaceable along a yarn guide rail, said yarn guide box being movable in parallel to a needle bed unit;

a mutual displacement finger which is brought into and out of contact with at least one associated yarn guide box; and a frame element surrounding each electromagnet from the center of one end of which said mutual displacement finger protrudes in the direction of movement of the associated armature rod, the other end of said frame element being acted upon by said armature rod, said frame element having two side legs by which said frame element is supported in a longitudinally movable manner.

2. The device as defined in claim 1, further comprising:

a rectangularly-shaped housing surrounding each electromagnet; and a guide plate fixed to opposite sides of said housing, wherein the associated frame element is guided between the guide plates and the housing.

3. The device as defined in claim 2, further comprising:

a crosspiece fixedly connected to the carriage unit, wherein each electromagnet and associated housing, guide plates and frame element form a complete component which is fixed, along with other similar complete components on said crosspiece.

4. The device as defined in claim 2, wherein each guide plate includes an axial guide groove facing said housing.

5. The device as defined in claim 1, wherein the mutual displacement finger and its associated frame element are formed of one piece, and wherein the frame element is plastic.

6. The device as defined in claim 1, wherein each frame element further has a lower and an upper crossleg joined to said side legs, and wherein at least one crossleg includes spaced apart axial ledges which come into contact with said housing.

7. The device as defined in claim 1, wherein each frame element further has a lower and an upper crossleg joined to said side legs, and wherein each crossleg includes spaced apart axial ledges which come into contact with said housing.

8. The device as defined in claim 1, further comprising:

a compression spring situated between the frame element and the housing.

9. The device as defined in claim 1, wherein each frame element further has an upper crossleg provided with an axial adjustment screw located opposite the armature rod of the associated electromagnet.

10. The device as defined in claim 1, wherein the side legs of each frame element are each provided with at least one groove-like recess extending along their length.

11. The device as defined in claim 1, wherein each frame element further has a lower and an upper crossleg joined to said side legs, and wherein at least one of said crosslegs includes a cut-out portion.

12. The device as defined in claim 1, wherein each frame element further has a lower and an upper crossleg joined to said side legs, and wherein each crossleg includes a cut-out portion.

* * * * *